United States Patent [19]

Nusair et al.

[11] Patent Number: 4,994,775

[45] Date of Patent: Feb. 19, 1991

[54] HIGH-PASS FILTER FOR MICROSTRIP CIRCUIT

[75] Inventors: Marwan E. Nusair; Michael D. Valentine; Stephen R. Scholl, all of Cincinnati, Ohio

[73] Assignee: Valentine Research, Inc., Cincinnati, Ohio

[21] Appl. No.: 425,693

[22] Filed: Oct. 23, 1989

[51] Int. Cl.[5] ..... H01P 1/203; H01P 3/08

[52] U.S. Cl. ..... 333/204; 333/208; 333/246

[58] Field of Search ..... 333/26, 33, 34, 208, 333/204, 246, 248, 21 R

[56] References Cited

U.S. PATENT DOCUMENTS

| | | | |
|---|---|---|---|
| 2,825,876 | 3/1958 | Le Vine et al. | 333/34 |
| 3,969,691 | 7/1976 | Saul | 333/21 R |
| 4,453,142 | 6/1984 | Murphy | 333/26 |
| 4,550,296 | 10/1985 | Ehrlinger et al. | 333/26 |
| 4,571,593 | 2/1986 | Martinson | 343/783 |
| 4,673,897 | 6/1987 | Chua et al. | 343/26 |

FOREIGN PATENT DOCUMENTS

| | | | |
|---|---|---|---|
| 2531575 | 2/1984 | France | 333/33 |

OTHER PUBLICATIONS

Izadian, Unified Design Plans and Waveguide Transitions, Microwaves & RF, May 1987, pp. 213–222.

Kompa, About the Frequency-Dependent Characteristics of a Microstrip-Waveguide Transition, Arch. Elektron and Uebertragungstech, vol. 35, No. 2, pp. 69–71, Feb. 1981.

*Primary Examiner*—Eugene R. LaRoche
*Assistant Examiner*—Seung Ham
*Attorney, Agent, or Firm*—Killworth, Gottman, Hagan & Schaeff

[57] ABSTRACT

A low loss high-pass microwave filter for microstrip circuits comprises a single-ridge waveguide which is attached to a microstrip circuit in a manner to establish a cutoff frequency for the circuit. The single-ridge waveguide has a top wall and sidewalls with a ridge projecting centrally from the top wall into the waveguide. The waveguide is associated with the microstrip circuit such that the sidewalls of the waveguide extend through a dielectric substrate of the circuit parallel to and on opposite sides of a microstrip line of the circuit and are connected electrically and physically to the ground plane, which forms a bottom wall for the waveguide. The ridge of the waveguide has a width which is equal to or narrower than the microstrip line and is aligned with the microstrip line. Within the waveguide, the microstrip line width is made to be substantially the same as the ridge width such that the microstrip line is narrowed within the waveguide if the ridge has a width which is narrower than the microstrip line outside the waveguide. The association of the waveguide and the microstrip circuit ensure that the ridge and the microstrip line are in good electrical and physical contact.

17 Claims, 2 Drawing Sheets

HIGH-PASS FILTER FOR MICROSTRIP CIRCUIT

BACKGROUND OF THE INVENTION

The present invention relates generally to filtering signals in microwave propagating media and, more particularly, to a method and apparatus for a low loss high-pass microwave filter for microstrip circuits.

Microstrip circuits are made up of a substrate formed of a dielectric material which separates a ground plane on one side of the substrate from a signal carrying microstrip line on the other. Use of microstrip circuits is preferred in many applications because their cost is negligible when compared to costlier waveguide structures. Additionally, electrical components are easily coupled to microstrip circuits, which have wide band and low loss characteristics. Microstrip circuits are also light in weight and easily printed using conventional printed circuit board technology.

A problem with using microstrip circuits is the design of a low loss high-pass filter which can be included on the microstrip circuit yet occupy a minimum amount of space on the circuit. A number of approaches to the solution of this problem are known in the prior art including edge-coupled lines, impedance transformers and low frequency signal rejection techniques. Waveguides offer another solution to the problem of low loss high-pass filters because of the inherent high attenuation of signals below the cutoff frequencies of waveguides. In addition, there are substantial low loss frequency ranges above the cutoff frequencies of waveguides. Unfortunately, the characteristics of waveguides are not realizable directly on microstrip circuits because the dominant desired mode in a microstrip circuit or quasi-transverse-electric-magnetic (quasi-TEM) mode has no cutoff frequency and will pass all frequencies down to DC. However, waveguide structure can be combined with microstrip circuits to provide high-pass filters.

For example, rectangular waveguides have been considered for use with microstrip circuits to provide high-pass filters as illustrated by an article entitled "About the Frequency-Dependent Characteristics of a Microstrip-Waveguide Transition" published in Arch. Elektron and Uebertragungstech., vol. 35, no. 2, pages 69–71, February, 1981 by Gunter Kompa. Unfortunately, such high-pass filters are generally restricted to a 2:1 usable frequency ratio in order to avoid losses due to the production of undesirable higher-order modes. Further, transitions of the type considered by Kompa are lossy and lead to external surface modes which allow certain lower-frequency modes to propagate on the outer surface of the waveguide.

Accordingly, there is a need for a low loss high-pass microwave filter which can be readily utilized with microstrip circuits and will occupy little space on the microstrip circuit.

SUMMARY OF THE INVENTION

This need is met in accordance with the present invention by a method and apparatus for a low loss high-pass microwave filter for microstrip circuits wherein a single-ridge waveguide structure is attached to a microstrip circuit in a manner to establish a cutoff frequency for the microstrip circuit thereby combining the characteristics of the waveguide with those of the microstrip circuit. As opposed to Kompa's rectangular waveguide transitions, the single-ridge waveguide high-pass filters of the present invention provide substantially higher bandwidth, possibly up to 15:1 usable frequency ratios. In addition, the invention allows for a frequency selective filter such that two frequencies can be passed with minimum loss, other high frequencies are passed with more loss and all frequencies below a designated cutoff frequency are highly attenuated. Further, the spurious modes and relatively high losses associated with the use of Kompa's rectangular waveguide transitions are avoided.

In accordance with one aspect of the present invention, a low loss high-pass microwave filter comprises a microstrip circuit having a dielectric substrate with a microstrip line on one side and a ground plane on the other and a length of single-ridge waveguide. The single-ridge waveguide has a top wall and sidewalls with a ridge projecting centrally from the top wall into the waveguide. The waveguide is associated with the microstrip circuit such that the sidewalls of the waveguide extend through the dielectric substrate parallel to and on opposite sides of the microstrip line and are connected electrically and physically to the ground plane. The ground plane of the microstrip circuit thus forms a bottom wall for the waveguide. The ridge of the waveguide has a width which is equal to or narrower than the microstrip line outside the waveguide and is aligned with the microstrip line. Within the waveguide, the microstrip line width is made to be substantially the same as the ridge width such that the microstrip line is narrowed within the waveguide if the ridge has a width which is narrower than the microstrip line outside the waveguide. The association of the waveguide and the microstrip circuit ensures that the ridge and the microstrip line are in good electrical and physical contact.

In accordance with another aspect of the present invention, a low loss high-pass microwave filter for a microstrip circuit having a dielectric substrate with a microstrip line on one side and a ground plane on the other comprises a length of generally E-shaped channel having top and sidewalls with a ridge projecting centrally from the top wall into the channel and having a width which is equal to or narrower than the microstrip line of the microstrip circuit. Coupler means provide for coupling the length of channel to the microstrip circuit such that the microstrip line is aligned with and in good electrical and physical contact with the ridge and the sidewalls of the channel are in good electrical and physical contact with the ground plane. The ground plane then forms a bottom wall to close the channel and thereby convert the E-shaped channel into a single-ridge waveguide.

The coupler means may comprise first and second slots in the microstrip circuit. The slots are positioned on opposite sides of and parallel to the microstrip line and sized to receive the sidewalls of the channel. The coupler means is completed by electrically conductive means for securing the sidewalls of the channel to the ground plane after the sidewalls have been inserted through the first and second slots. Preferably, the electrically conductive means comprises solder.

In a first embodiment of the present invention, the ridge width is made equal to the width of the microstrip line, the waveguide has a constant cross-section which is selected to make the impedance of the waveguide equal to the impedance of the microstrip circuit, and the length of the waveguide is selected to provide the required attenuation below a cutoff frequency defined by the filter.

In a second embodiment of the present invention, the filter is frequency selective in that two high frequencies, $f_1$ and $f_2$, are passed with low loss while remaining high frequencies are passed but with higher loss. In this embodiment, the waveguide has a constant cross-section which is selected to make the impedance of the waveguide different than the impedance of the microstrip circuit to create a mismatch therebetween, and the length of the waveguide is made equal to one-half of the wavelength corresponding to the lower of the two pass frequencies $f_1$ in the waveguide the cutoff frequency of this filter is defined by the equation:

$$f_c = \sqrt{(4f_1^2 - f_2^2)/3}.$$

In accordance with yet another aspect of the present invention, a method of making a low loss high-pass microwave filter for a microstrip circuit having a dielectric substrate with a microstrip line on one side and a ground plane on the other comprises the steps of: making a length of generally E-shaped channel having top and sidewalls with a ridge projecting centrally from the top wall into the channel, the ridge having a width which is equal to or narrower than the microstrip line of the microstrip circuit; and, coupling the length of channel to the microstrip circuit such that the microstrip line is aligned with and in good electrical and physical contact with the ridge and the sidewalls of the channel are in good electrical and physical contact with the ground plane which then forms a bottom wall to close the channel and thereby define a single-ridge waveguide.

The step of coupling the length of channel to the microstrip circuit may comprise the steps of: making slots in the dielectric substrate parallel to and on opposite sides of the microstrip line, the slots being sized to receive the sidewalls of the channel; inserting the sidewalls of the length of channel into the slots such that the ridge is aligned with and in good electrical and physical contact with the microstrip line, the sidewalls of the channel being sized to extend to the ground plane; and, securing the length of channel to the microstrip circuit such that the sidewalls of the channel are in good electrical and physical contact with the ground plane which then forms a bottom wall to close the channel and thereby define a single-ridge waveguide. The step of securing the length of channel to the microstrip circuit preferably comprises soldering the sidewalls to the ground plane. Soldering the sidewalls to the ground plane is most easily performed by extending the slots through the ground plane, extending the sidewalls through the ground plane and soldering the portions of the sidewalls extending beyond the ground plane to the ground plane.

In accordance with still another aspect of the present invention, a method of making a low loss high-pass microwave filter for a microstrip circuit having a dielectric substrate with a microstrip line on one side and a ground plane on the other comprises the steps of: making a length of generally E-shaped channel having top and sidewalls with a ridge projecting centrally from the top wall into the channel, the ridge having a width which is equal to or narrower than the microstrip line of the microstrip circuit; making slots in the dielectric substrate parallel to and on opposite sides of the microstrip line, the slots being sized to receive the sidewalls of the channel; inserting the sidewalls of the length of channel into the slots such that the ridge is aligned with and in good electrical and physical contact with the microstrip line, the sidewalls of the channel being sized to extend to the ground plane; and, coupling the length of channel to the microstrip circuit such that the sidewalls of the channel are in good electrical and physical contact with the ground plane which then forms a bottom wall to close the channel and thereby define a single-ridge waveguide.

In accordance with a final aspect of the present invention, a method of making a low loss high-pass microwave filter for a microstrip circuit having a dielectric substrate with a microstrip line on one side and a ground plane on the other comprises the steps of: making a length of single-ridge waveguide having a top wall and sidewalls with a ridge projecting centrally from the top wall into the waveguide; making slots in the dielectric substrate parallel to and on opposite sides of the microstrip line, the slots being sized to receive the sidewalls of the waveguide; extending the sidewalls of the waveguide through the slots in the dielectric substrate, the ridge having a width which is equal to or narrower than the microstrip line and being aligned and in good electrical and physical contact therewith; and, electrically and physically connecting the sidewalls to the ground plane to form a bottom wall for the waveguide. If the ridge is narrower than the microstrip line outside the waveguide, the methods further comprise narrowing the microstrip line within the waveguide to equal the width of the ridge.

It is thus an object of the present invention to provide a method and apparatus for a low loss high-pass microwave filter for microstrip circuits wherein a single-ridge waveguide is attached to a microstrip circuit to define the filter; to provide a method and apparatus for a low loss high-pass microwave filter for microstrip circuits wherein a single-ridge waveguide is attached to a microstrip circuit by forming slots adjacent a microstrip line of the circuit, inserting sidewalls of the waveguide through the slots such that the ridge of the waveguide contacts the microstrip line, and connecting the sidewalls to a ground plane of the microstrip circuit; and, to provide a method and apparatus for a low loss high-pass microwave filter for microstrip circuits wherein a single-ridge waveguide is sized and attached to a microstrip circuit such that the filter is frequency selective.

Other objects and advantages of the invention will be apparent from the following description, the accompanying drawings and the appended claims.

DETAILED DESCRIPTION OF THE INVENTION

Figure 1:
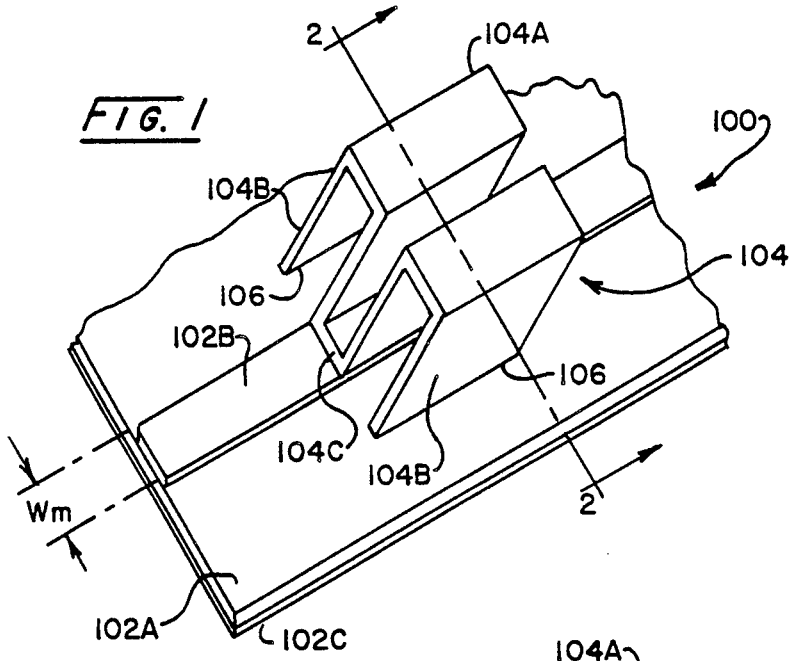
FIG. 1 is a perspective view of a low loss high-pass filter in accordance with the present invention wherein a single-ridge waveguide is combined with a microstrip circuit.
Figure 3:
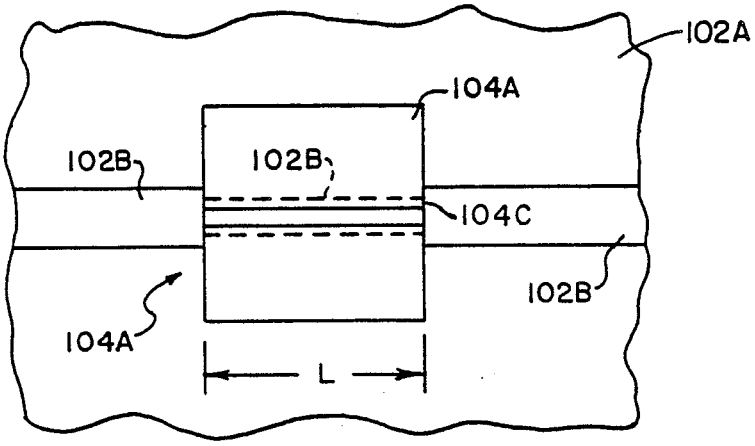
FIG. 3 is a plan view of a low loss high-pass filter in accordance with the present invention wherein the ridge is narrower than a microstrip line which is reduced in width within the waveguide.

FIG. 1 is a perspective view of a low loss high-pass microwave filter 100 for a microstrip circuit 102 having a dielectric substrate 102A with a microstrip line 102B on one side and a ground plane 102C on the other. A length of generally E-shaped channel 104 oriented on its side to have a top wall 104A and sidewalls 104B with a ridge 104C projecting centrally from the top wall 104A into the channel 104 and having a width which is equal to or narrower than, i.e. no wider than, the microstrip line 102B of the microstrip circuit 102 is combined with the microstrip circuit 102 to form the filter 100. If the ridge 104C is narrower than the microstrip line 102B outside the channel 104, the microstrip line 102B is narrowed within the channel 104 to equal the width of the ridge 104C, see FIG. 3.

Coupler means provide for coupling the length of channel 104 to the microstrip circuit 102 such that the microstrip line 102B is aligned with and in good electrical and physical contact with the ridge 104C and the sidewalls 104B of the channel 104 are in good electrical and physical contact with the ground plane 102C. The ground plane 102C then forms a bottom wall to close the E-shaped channel 104 and thereby convert the channel 104 into a single-ridge waveguide 104A, 104B, 104C, 102C. Preferably, the ridge 104C is firmly attached to the microstrip line 102B such that the microstrip line 102B becomes part of the ridge 104C. Attachment may be by electrically conductive adhesive, solder or otherwise.

Figure 2:
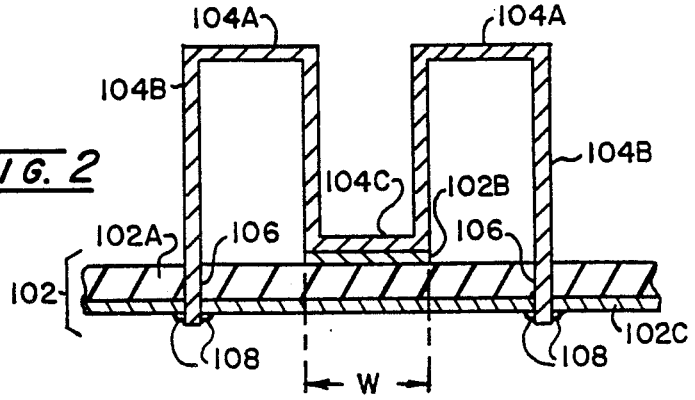
FIG. 2 is a sectional view of the low loss high-pass filter of FIG. 1 taken along a vertical section plane passing through the section line 2—2 of FIG. 1.

In addition, the coupler means comprises first and second slots 106 through the microstrip circuit 102. The slots 106 are positioned on opposite sides of and parallel to the microstrip line 102B and sized to receive the sidewalls 104B of the channel 104. The coupler means is completed by electrically conductive means for securing the sidewalls 104B of the channel 104 to the ground plane 102C after the sidewalls 104B have been inserted through the first and second slots 106. Preferably, the electrically conductive means comprises solder 108. Soldering the sidewalls 104B to the ground plane 102C is most easily performed by extending the slots 106 through the ground plane 102C, extending the sidewalls 104B through the ground plane 102C and soldering the portions of the sidewalls 104B extending beyond the ground plane 102C to the ground plane 102C as shown in FIG. 2. However, it should be apparent that alternate coupler means could be provided. For example, the coupler means can comprise electrically conductive adhesive for securing the sidewalls 104B to the upper surface of the ground plane 102C. For such coupler means, the ground plane 102C of course would not be slotted.

Figure 4:
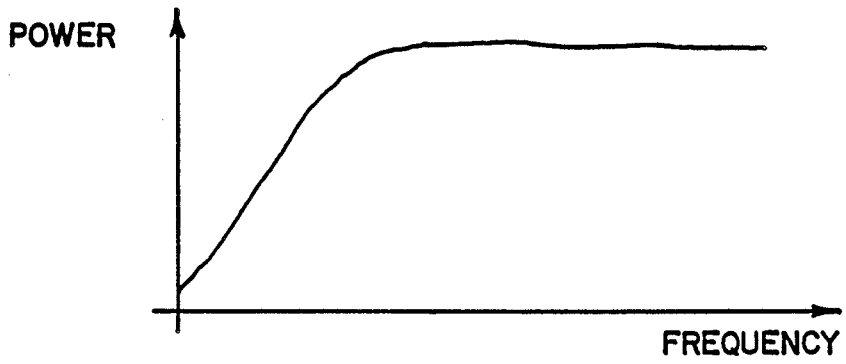
FIG. 4 is a graph of a response curve for a high-pass filter which can be achieved by a first embodiment of the present invention.

In a first embodiment of the present invention, the ridge width W is made equal to the width $W_m$ of the microstrip line 102B, the waveguide 104A, 104B, 104C, 102C has a constant cross-section which is selected to make the impedance of the waveguide 104A, 104B, 104C, 102C equal to the impedance of the microstrip circuit 102, and the length of the waveguide 104A, 104B, 104C, 102C is selected to provide the required attenuation below a cutoff frequency $f_c$ defined by the filter 100. This embodiment of the invention results in a high-pass filter having a typical frequency response curve as shown in FIG. 4.

Figure 5:
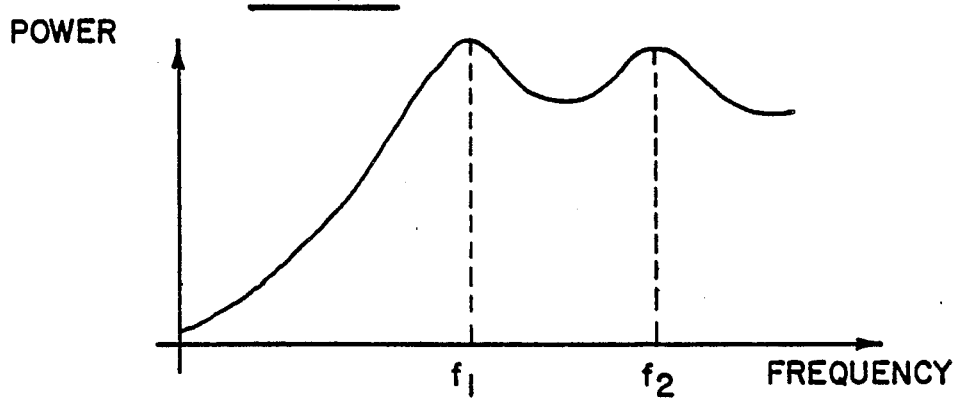
FIG. 5 is a graph of a response curve for a high-pass filter which can be achieved by a second embodiment of the present invention wherein two high frequencies, $f_1$ and $f_2$, are passed with low loss while remaining high frequencies are passed but with higher loss.

In a second embodiment of the present invention, the filter 100 is frequency selective in that two high frequencies, $f_1$ and $f_2$, are passed with low loss while remaining high frequencies are passed but with higher loss. The frequency response curve of the second embodiment is shown in FIG. 5. In this embodiment the waveguide 104A, 104B, 104C, 102C has a constant cross-section which is selected to make the impedance of the waveguide 104A, 104B, 104C, 102C different than the impedance of the microstrip circuit 102 to create a deliberate mismatch between them, and the length of the waveguide 104A, 104B, 104C, 102C is made equal to one-half of the wavelength corresponding to the lower of the two pass frequencies $f_1$ in the waveguide. The cutoff frequency of this filter is defined by the equation:

$$f_c = \sqrt{(4f_1^2 - f_2^2)/3}.$$

The length L of the waveguide 104A, 104B, 104C, 102C section is then determined by the formula:

$$L = \tfrac{1}{2}\text{Lambda}_1 l = \text{Lambda}_2$$

where $\text{Lambda}_1$ is the wavelength corresponding to the frequency $f_1$ in the structure of the waveguide 104A, 104B, 104C, 102C. This ensures that the waveguide length is equal to half the wavelength at $f_1$ and is equal to the full wavelength at $f_2$ for any defined cutoff frequency. This allows the filter 100 to act as a coupled resonant cavity at both frequencies $f_1$ and $f_2$ as well as other frequencies much higher in frequency than $f_2$ and hence of no consequence to operation of this embodiment of the filter 100. In a preferred embodiment of this frequency selective filter, $f_1 = 24.15$ GHz and $f_2 = 34.3$ GHz which leads to an $f_c = 19.6$ GHz and a length L of approximately 0.21 inches for a substrate 102A which is 0.030 inches thick and has a dielectric constant of approximately 2.94.

In conjunction with the apparatus of the present invention as described above, the invention also contemplates a method of making the low loss high-pass microwave filter 100. The method comprises the steps of: making a length of generally E-shaped channel 104 having top and sidewalls 104A, 104B with a ridge 104C projecting centrally from the top wall 104A into the channel 104, the ridge 104C having a width which is equal to or narrower than the microstrip line 102B of the microstrip circuit 102; and, coupling the length of channel 104 to the microstrip circuit 102 such that the microstrip line 102B is aligned with and in good electrical and physical contact with the ridge 104C and the sidewalls 104B of the channel 104 are in good electrical and physical contact with the ground plane 102C which then forms a bottom wall to close the channel 104 and thereby define a single-ridge waveguide 104A, 104B, 104C, 102C.

The step of coupling the length of channel 104 to the microstrip circuit 102 may comprise the steps of: making slots 106 in the dielectric substrate 102A parallel to and on opposite sides of the microstrip line 102B, the slots 106 being sized to receive the sidewalls 104B of the channel 104; inserting the sidewalls 104B of the length of channel 104 into the slots 106 such that the ridge 104C is aligned with and in good electrical and physical contact with the microstrip line 102B, the sidewalls 104B of the channel 104 being sized to extend to the ground plane 102C; and, securing the length of channel 104 to the microstrip circuit 102B such that the sidewalls 104B of the channel 104 are in good electrical and physical contact with the ground plane 102C which then forms a bottom wall to close the channel 104C and thereby define a single-ridge waveguide 104A, 104B, 104C, 102C.

The step of securing the length of channel 104 to the microstrip circuit 102 preferably comprises soldering the sidewalls 104B to the ground plane 102C. Soldering the sidewalls 104B to the ground plane 102C is most easily performed by extending the slots 106 through the ground plane 102C, extending the sidewalls 104B through the ground plane 102C and soldering the portions of the sidewalls 104B extending beyond the ground plane 102C to the ground plane 102C. If the ridge 104C is narrower than the microstrip line 102B outside the waveguide 104A, 104B, 104C, 102C, the method further comprises the step of narrowing the microstrip line 102B within the waveguide 104A, 104B, 104C, 102C to equal the width W of the ridge 104C.

Having thus described the high-pass filter for a microstrip circuit of the present invention in detail and by reference to preferred embodiments thereof, it will be apparent that modifications and variations are possible without departing from the scope of the invention defined in the appended claims.

What is claimed is:

1. A low loss high-pass microwave filter comprising:

a microstrip circuit having a dielectric substrate with a microstrip line on one side and ground plane on the other; and a length of single-ridge waveguide having a top wall and sidewalls with a ridge projecting centrally from the top wall into said waveguide, said sidewalls extending through said dielectric substrate parallel to and on opposite sides of said microstrip line and being connected electrically and physically to said ground plane to form a bottom wall for said waveguide, said ridge having a width which is no wider than said microstrip line and is aligned with and in good electrical and physical contact therewith.

2. A low loss high-pass microwave filter for a microstrip circuit as claimed in claim 1 wherein said ridge has a width which is narrower than said microstrip line and said microstrip line is reduced in width over the portion in contact with said ridge to equal the width of said ridge.

3. A low loss high-pass microwave filter for a microstrip circuit having a dielectric substrate with a microstrip line on one side and a ground plane on the other, said filter comprising:

a length of generally E-shaped channel having top and sidewalls with a ridge projecting centrally from the top wall into said channel, said ridge having a width which is no wider than the microstrip line of said microstrip circuit; and coupler means for coupling said length of channel to said microstrip circuit such that the microstrip line is aligned with and in good electrical and physical contact with the ridge and the sidewalls of said channel are in good electrical and physical contact with the ground plane which then forms a bottom wall to close said channel and thereby define a single-ridge waveguide.

4. A low loss high-pass microwave filter for a microstrip circuit as claimed in claim 3 wherein said ridge has a width which is narrower than said microstrip line and said microstrip line is reduced in width within said single-ridge waveguide to equal the width of said ridge.

5. A low loss high-pass microwave filter for a microstrip circuit as claimed in claim 4 wherein said coupler means comprises:

first and second slots in said microstrip circuit, said first and second slots being on opposite sides of and parallel to said microstrip line and sized to receive the sidewalls of said channel; and electrically conductive means for securing the sidewalls of said channel to said ground plane after said sidewalls have been inserted through said first and second slots.

6. A low loss high-pass microwave filter for a microstrip circuit as claimed in claim 5 wherein said electrically conductive means comprises solder.

7. A low loss high-pass microwave filter for a microstrip circuit as claimed in claim 3 wherein the ridge width is made equal to the width of the microstrip line, the waveguide has a constant cross-section which is selected to make the impedance of the waveguide equal to the impedance of the microstrip circuit, and the length of the waveguide is selected to provide the required attenuation below a cutoff frequency defined by the filter.

8. A low loss high-pass microwave filter for a microstrip circuit having a dielectric substrate with a microstrip line on one side and a ground plane on the other, said filter comprising:

a length of generally E-shaped channel having top and sidewalls with a ridge projecting centrally from the top wall into said channel, said ridge having a width which is no wider than the microstrip line of said microstrip circuit; and coupler means for coupling said length of channel to said microstrip circuit such that the microstrip line is aligned with and in good electrical and physical contact with the ridge and the sidewalls of said channel are in good electrical and physical contact with the ground plane which then forms a bottom wall to close said channel and thereby define a single-ridge waveguide such that the filter is frequency selective in that two high frequencies, $f_1$ and $f_2$, are passed with low loss while remaining high frequencies are passed but with higher loss, the waveguide having a constant cross-section which is selected to make the impedance of the waveguide different than the impedance of the microstrip circuit to create a mismatch therebetween, and the length of the waveguide is made equal to one-half of the wavelength corresponding to the lower of the two pass frequencies $f_1$ in the waveguide.

9. A low loss high-pass microwave filter for a microstrip circuit having a dielectric substrate with a microstrip line on one side and a ground plane on the other, said filter comprising:

a length of generally E-shaped channel having top and sidewalls with a ridge projecting centrally from the top wall into said channel, said ridge having width which is no wider than the microstrip line of said microstrip circuit; and coupler means for coupling said length of channel to said microstrip circuit such that the microstrip line is aligned with and in good electrical and physical contact with the ridge and the sidewalls of said channel are in good electrical and physical contact with ground plane which then forms a bottom wall to close said channel and thereby define a single-ridge waveguide such that the filter is frequency selective in that two high frequencies, $f_1$ and $f_2$, are passed with low loss while remaining high frequencies are passed but with higher loss, the waveguide having a constant cross-section which is selected to make the impedance of the waveguide different than the impedance of the microstrip circuit to create a mismatch therebetween, the length of the waveguide is made equal to one-half of the wavelength corresponding to the lower of the two pass frequencies $f_1$ in the waveguide, and the cutoff frequency of the filter is defined by the equation:

$$f_c=(4f_1^2-f_2^2)/3.$$

10. A method of making a low loss high-pass microwave filter for a microstrip circuit having a dielectric substrate with a microstrip line on one side and a ground plane on the other, said method comprising the steps of:

making a length of generally E-shaped channel having top and sidewalls with a ridge projecting centrally from the top wall into said channel, said ridge having a width which is no wider than the microstrip line of said microstrip circuit; and coupling said length of channel to said microstrip circuit such that the microstrip line is aligned with and in good electrical and physical contact with the ridge and the sidewalls of said channel are in good electrical and physical contact with the ground plane which then forms a bottom wall to close said channel and thereby define a single-ridge waveguide.

11. A method of making a low loss high-pass microwave filter as claimed in claim 10 wherein said ridge has a width which is narrower than the microstrip line of said microstrip circuit and said method further comprises the step of narrowing the microstrip line within the waveguide to equal the width of said ridge.

12. A method of making a low loss high-pass microwave filter as claimed in claim 10 wherein the step of coupling said length of channel to said microstrip circuit comprises the steps of:

making slots in said dielectric substrate parallel to and on opposite sides of said microstrip line, said slots being sized to receive the sidewalls of said channel;

inserting the sidewalls of said length of channel into said slots such that the ridge is aligned with and in good electrical and physical contact with the microstrip line, the sidewalls of said channel being sized to extend to said ground plane; and securing said length of channel to said microstrip circuit such that the sidewalls of said channel are in good electrical and physical contact with the ground plane which then forms a bottom wall to close said channel and thereby define a single-ridge waveguide.

13. A method of making a low loss high-pass microwave filter as claimed in claim 12 wherein the step of securing said length of channel to said microstrip comprises the step of soldering said sidewalls to said ground plane.

14. A method of making a low loss high-pass microwave filter for a microstrip circuit having a dielectric substrate with a microstrip line on one side and a ground plane on the other, said method comprising the steps of:

making a length of generally E-shaped channel having top and sidewalls with a ridge projecting centrally from the top wall into the channel, said ridge having a width which is no wider than the microstrip line of said microstrip circuit;

making slots in said dielectric substrate parallel to and on opposite sides of said microstrip line, said slots being sized to receive the sidewalls of said channel;

inserting the sidewalls of said length of channel into said slots such that the ridge is aligned with and in good electrical and physical contact with the microstrip line, the sidewalls of said channel being sized to extend to said ground plane; and coupling said length of channel to said microstrip circuit such that the sidewalls of said channel are in good electrical and physical contact with the ground plane which then forms a bottom wall to close said channel and thereby define a single-ridge waveguide.

15. A method of making a low loss high-pass microwave filter as claimed in claim 14 wherein said ridge has a width which is narrower than the microstrip line of said microstrip circuit and said method further comprises the step of narrowing the microstrip line within the waveguide to equal the width of said ridge.

16. A method of making a low loss high-pass microwave filter for a microstrip circuit having a dielectric substrate with a microstrip line on one side and a ground plane on the other, said method comprising the steps of:

making a length of single-ridge waveguide having a top wall and sidewalls with a ridge projecting centrally from the top wall into said waveguide;

making slots in said dielectric substrate parallel to and on opposite sides of said microstrip line, said slots being sized to receive the sidewalls of said waveguide;

extending the sidewalls of said waveguide through the slots in said dielectric substrate, said ridge having a width which is no wider than said microstrip line and being aligned and in good electrical and physical contact therewith; and electrically and physically connecting said sidewalls to said ground plane to form a bottom wall for said waveguide.

17. A method of making a low loss high-pass microwave filter as claimed in claim 16 wherein said ridge has a width which is narrower than the microstrip line of said microstrip circuit and said method further comprises the step of narrowing the microstrip line within the waveguide to equal the width of said ridge.

* * * * *

UNITED STATES PATENT AND TRADEMARK OFFICE

CERTIFICATE OF CORRECTION

PATENT NO. : 4,994,775

DATED : February 19, 1991

INVENTOR(S) : Marwan E. Nusair et al

It is certified that error appears in the above-identified patent and that said Letters Patent is hereby corrected as shown below:

Col. 1, Line 36, "cutoff" should be --lower cutoff--.
Col. 3, Line 13, "waveguide the" should be --waveguide. the--.

Signed and Sealed this

Twenty-eighth Day of July, 1992

*Attest:*

DOUGLAS B. COMER

*Attesting Officer*

*Acting Commissioner of Patents and Trademarks*